US009359801B2

(12) United States Patent
Weber

(10) Patent No.: US 9,359,801 B2
(45) Date of Patent: Jun. 7, 2016

(54) DAMPER FOR FURNITURE

(75) Inventor: Konrad Weber, Ebsdorfergrund (DE)

(73) Assignee: DRUCK-UND SPRITZGUSSWERK HETTICH GMBH & CO. KG, Frankenberg (DE)

( * ) Notice: Subject to any disclaimer, the term of this patent is extended or adjusted under 35 U.S.C. 154(b) by 290 days.

(21) Appl. No.: 13/266,970

(22) PCT Filed: Apr. 16, 2010

(86) PCT No.: PCT/EP2010/055035
§ 371 (c)(1),
(2), (4) Date: Dec. 28, 2011

(87) PCT Pub. No.: WO2010/124946
PCT Pub. Date: Nov. 4, 2010

(65) Prior Publication Data

US 2012/0096679 A1 Apr. 26, 2012

(30) Foreign Application Priority Data

Apr. 28, 2009 (DE) ..... 20 2009 004 751 U

(51) Int. Cl.
*E05F 5/10* (2006.01)

(52) U.S. Cl.
CPC ..... *E05F 5/10* (2013.01); *E05Y 2900/20* (2013.01); *Y10T 16/54* (2015.01); *Y10T 16/61* (2015.01)

(58) Field of Classification Search
CPC ..... F16F 9/54; F16F 9/3207; E05F 5/10; E05Y 2201/256
USPC ..... 188/321.11, 281, 281.1, 282.6, 286; 16/54; 267/120
See application file for complete search history.

(56) References Cited

U.S. PATENT DOCUMENTS

| | | | | |
|---|---|---|---|---|
| 1,050,571 | A * | 1/1913 | Smith | 188/321.11 |
| 4,438,908 | A * | 3/1984 | Terada | 267/219 |
| 5,730,262 | A * | 3/1998 | Rucks et al. | 188/321.11 |
| 5,794,742 | A * | 8/1998 | Lack et al. | 188/321.11 |
| 6,010,119 | A * | 1/2000 | Hsiao | 267/64.12 |
| 7,318,505 | B2 * | 1/2008 | Muller et al. | 188/321.11 |
| 7,637,128 | B2 * | 12/2009 | Kim | 68/23.1 |
| 2003/0178268 | A1 * | 9/2003 | Ananthanarayanan et al. | 188/321.11 |
| 2006/0118371 | A1 * | 6/2006 | Zimmer et al. | 188/280 |

FOREIGN PATENT DOCUMENTS

| | | | | |
|---|---|---|---|---|
| DE | 20 2004 009 535 | | 12/2005 | |
| DE | 20 2007 004 621 | | 9/2008 | |
| GB | 2131119 | A * | 6/1984 | F16F 9/19 |
| WO | 2007/099100 | | 7/2007 | |

* cited by examiner

*Primary Examiner* — Xuan Lan Nguyen
(74) *Attorney, Agent, or Firm* — Barnes & Thornburg LLP

(57) ABSTRACT

The invention relates to a damper (1) for furniture, especially hinges, comprising a housing (2) in which a piston (8) is connected to a piston rod (3) and can be displaced. A fluid flows through at least one flow channel (11) on or in the piston (8) during a movement of the piston (8) inside the housing (2). A connecting element (4) having a seat (5) for coupling a drive element thereto is provided on the piston rod (3) on the end section projecting from the housing (2). The seat (5) has a cut-out section (18) on the face of the of the piston rod (3) accommodated therein, said cut-out section allowing the direct mechanical contact of a face (17) of the piston rod (3) and a drive element accommodated in the seat (5) so that there is a direct flux of force in the axial direction from the drive element accommodated in the seat towards the piston rod (3) when pressure is applied.

12 Claims, 2 Drawing Sheets

DAMPER FOR FURNITURE

This application is a national stage of International Application PCT/EP2010/055035, filed Apr. 16, 2010, and claims benefit of and priority to German Patent Application No. 20 2009 004 751.2, filed Apr. 28, 2009, the content of which Applications are incorporated by reference herein.

The present invention relates to a damper for furniture, especially for hinges, comprising a housing in which a piston connected to a piston rod is received so that it can be displaced, where a fluid flows through a flow channel on or in the piston during a movement of the piston inside the housing and a connecting element having a seat for coupling to a drive element is provided on the piston rod on the end section projecting on the housing.

WO 2007/099100 A2 discloses a damper for furniture in which a piston with a piston rod is disposed displaceably in housing. During a movement of the piston, damping takes place via the throttle effect of a flow channel, where the damping forces are different during insertion and withdrawal of the piston rod. It has proved to be advantageous to execute such dampers as pressure dampers, i.e. the actuating force is higher during insertion of the piston rod. A connecting element is mounted on the end portion of the piston rod projecting from the housing, which element is configured as latching element and comprises an outwardly open eye. As a result, a bolt can be engaged on the connecting element. With this type of coupling of a damper, it is disadvantageous that the coupling between the connecting element and the piston rod does not have a sufficient load-bearing capacity. Particularly during insertion of the piston rod, the plastic connecting element can be damaged by high compressive loads so that the damper is destroyed.

It is therefore the object of the present invention to provide a damper for furniture which can also withstand high compressive loads.

This object is achieved with a damper having the features of claim 1.

According to the invention, a face of the piston rod is disposed on the seat of the connecting element such that a component disposed in the seat, for example, a bolt of a movable hinge part, can abut directly and immediately on the face of the piston rod. Now, a direct transmission of force between the component disposed in the seat and the piston rod is possible specifically when pressure is applied. Whereas the connecting element does not need to transmit the compressive load. This prevents the material of the usually softer connecting element from becoming damaged under high loads, which can then cause deformations or cracks, which endanger the hold of the connecting element on the piston rod.

A cut-out section is formed on the connecting part, on which a part of the face of the piston rod is disposed and which allows direct mechanical contact of a face of the piston rod with a drive element mounted in the seat so that there is a direct flow of force in the axial direction from the drive element mounted in the seat towards the piston rod when pressure is applied. The cut-out section can preferably be configured to be slit-shaped and extend over the entire length of the face. It is thereby possible to predefine the contact surface on the face, in particular when the seat is configured as a substantially cylindrical eye, in which a bolt-shaped component is inserted. The contact surface for this bolt can then be formed on the slit-shaped seat.

For a high transmission of force, the piston rod is preferably formed from metal. The connecting element can thereby be plugged onto the piston rod for easy assembly. Since the transmission of force takes place directly between the component inserted in the seat and the piston rod, the connecting element can be made of plastic and be engaged on the piston rod since the connecting element need not absorb the high compressive loads. The engagement consequently is only used for transmission of force during withdrawal of the piston rod from the housing, which requires much less force.

The damper is preferably configured as a pressure damper which produces higher damping forces during insertion of the piston rod into the housing than during withdrawal. This ensures that a closure movement, for example in the case of a furniture door, is damped whilst an opposite opening movement can be executed largely unhindered. In this respect, the pressure peaks or high actuation forces only occur during movement of the piston rod in the direction of insertion.

At the ends of the piston rod acting in the piston, the high forces must be transmitted from the piston rod via a piston rod part onto the piston. To this end, in a further embodiment the piston is fixed on the piston rod by means of a metal slider. As a result, high compressive forces can be transmitted from the piston rod onto the piston. The slider can thereby be engaged or clamped on the piston and/or the piston rod.

The invention is explained in detail hereinafter by means of two exemplary embodiments with reference to the appended drawings. In the figures.

Figure 1:
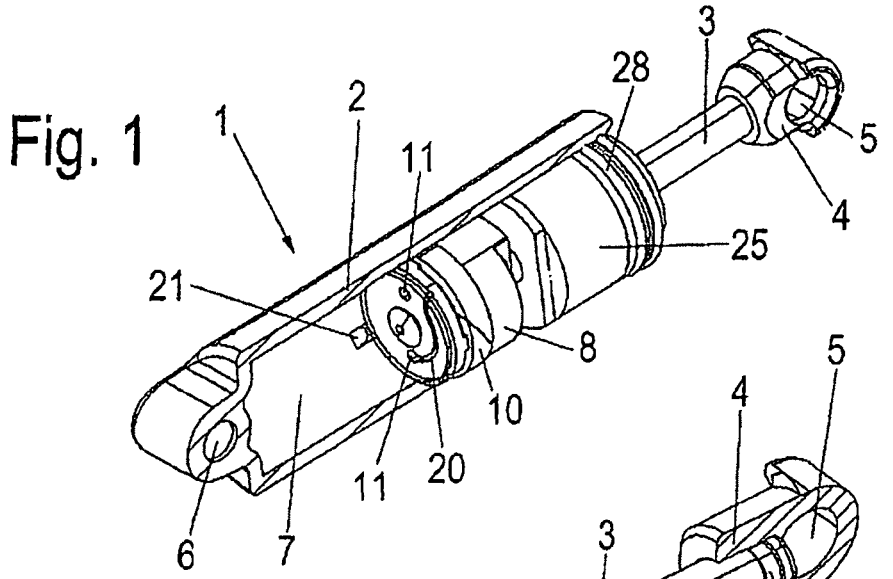
FIG. 1 shows a perspective view of a damper according to the invention.

A damper 1, especially for furniture, comprises a substantially cylindrical housing 2, from which a piston rod 3 projects. A connecting element 4 having a through opening 5 disposed perpendicular to the axial direction is formed on the piston rod 3 at one end, to which connecting element a bolt, for example, of a hinge can be fitted. A through opening 6 likewise extending perpendicular to the longitudinal direction is formed on the housing 2 on the opposite side for connection to another bolt.

Located in the housing 2 is an interior 7 on which a piston 8 displaceable in the axial direction is provided. The piston 8 has an annular seat 9 for a sealing ring 10, which guides the piston 8 along on an inner wall of the housing 2. One or more grooves 21 extending in the axial direction can be provided on the inner wall of the housing 2, by which means a bypass is formed for the passage of a fluid. On the piston 8 a groove-shaped channel 20 is cut out on one face, which is covered by a valve disk (not shown). The valve disk ensures that the channel 20 is closed during insertion of the piston rod 3 and consequently a throttling gap is formed. During withdrawal of the piston rod 3, the valve disk is raised from the face of the piston 8 as a result of the negative pressure so that a larger flow channel to the through openings 11 is formed.

On the open side of the housing 2, the damper 1 further comprises a cover 28 and an adjacently disposed compensating element 25 by which means volume compensation is accomplished during a movement of the piston 8 to compensate for the fluid volume displaced by the piston rod.

Figure 2:
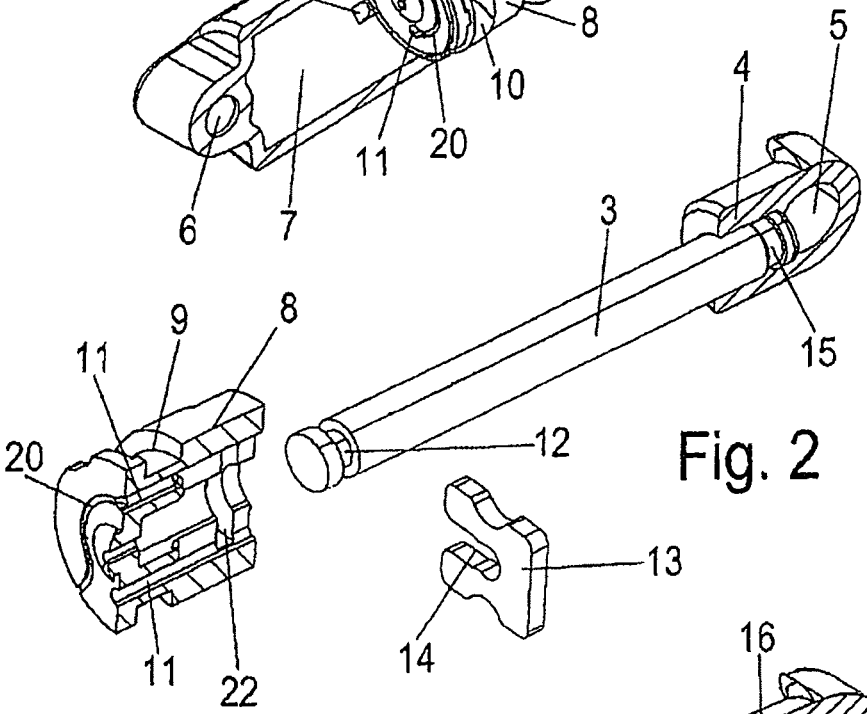
FIGS. 2 and 3 show two views of the damper from FIG. 1 without the housing.
Figure 3:
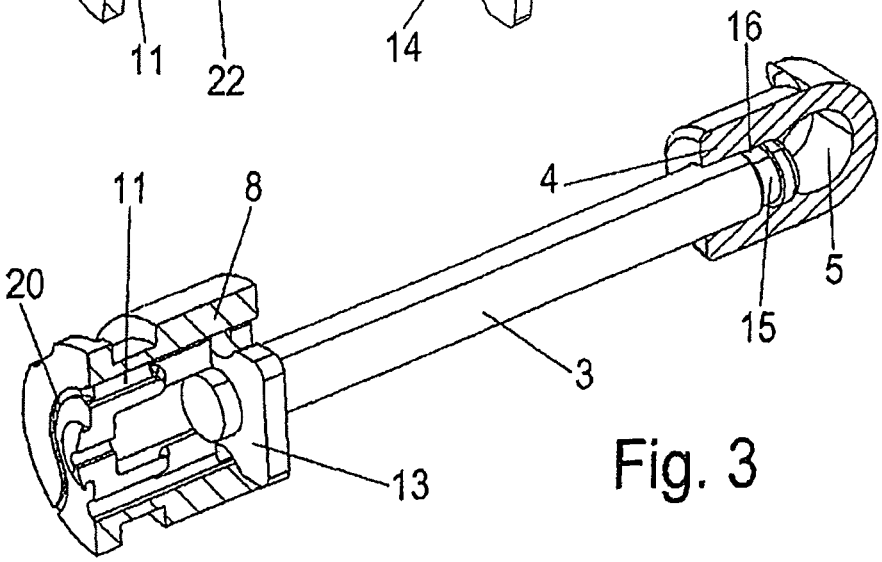
Figure 4:
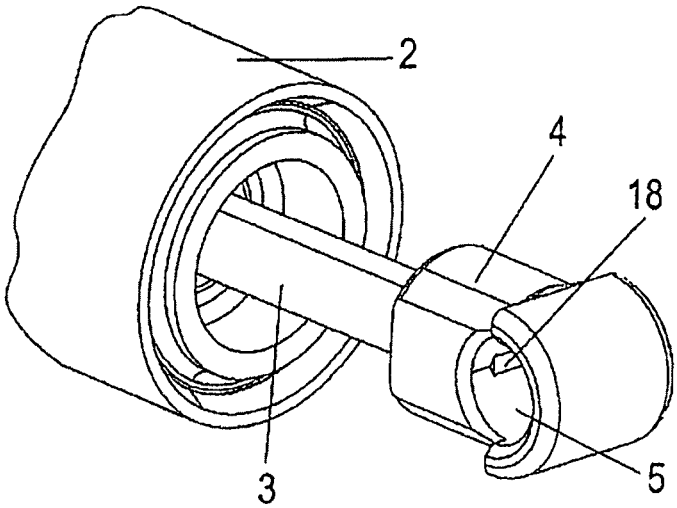
FIGS. 4 to 6 show several detailed views of the piston rod with the connecting element of the damper from FIG. 1.
Figure 5:
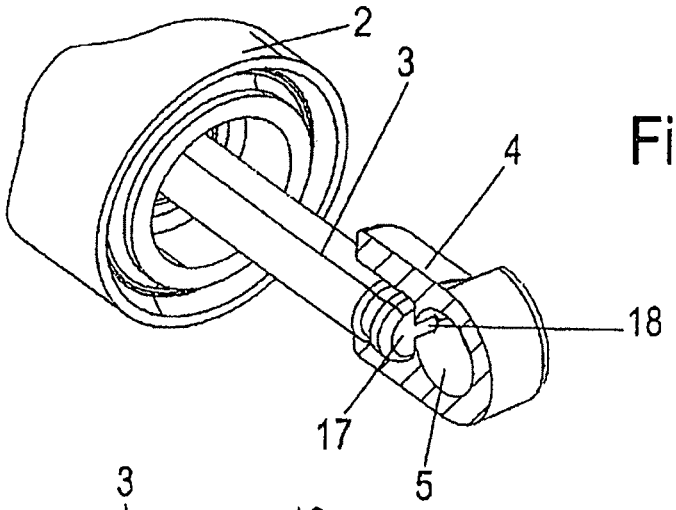
Figure 6:
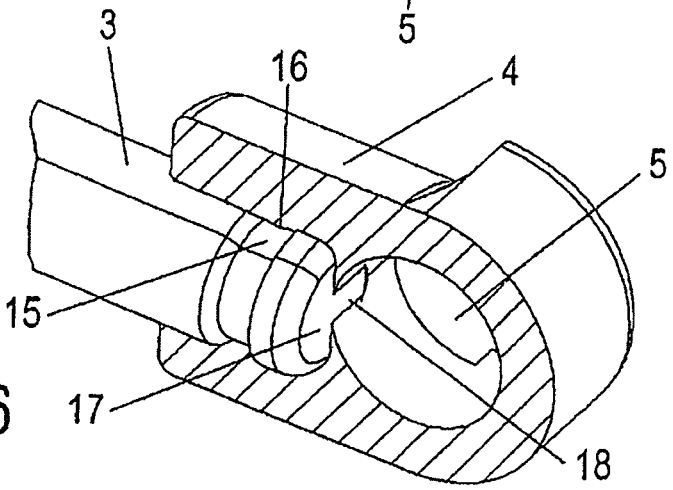

The piston rod 3 is shown in detail in FIGS. 2 to 5. At each of the opposite end sections the piston rod 3 has an annular groove 12 or 15. The piston 8 is fixed on the annular groove 12 by means of a slider 13. The slider 13 preferably consists of metal and is U-shaped so that a seat 14 is provided for sliding the slider 13 into the groove 12 on the piston rod 3. The piston 8 has a gap-shaped seat 22 for the slider 13, which is accessible for mounting of the slider 13 on the piston circumference. When a slider 13 is mounted in the piston 8, axial forces are transmitted to the piston 8 via the piston rod 3. At the same time, it is in particular the broadly shaped surfaces of the slider 13 which support the connection between piston rod 3 and piston 8 against the axial forces in order to thus avert penetration of the piston rod 3 through the piston 8. The damper 1 is thereby configured as a pressure damper so that in particular during insertion of the piston rod 3 into the housing 2, high loads occur when the channel 20 is covered by a valve disk.

On the opposite side of the piston rod 3 there is provided a connecting element 4 made of plastic which engages on the annular groove 15. The connecting element 4 has a cylindrical seat 5 into which a bolt of a lever of a hinge can be inserted. The seat 5 is configured such that a part of one face 17 of the piston rod 3 is visible. For this purpose a slit 18 is formed on the seat 5, extending over the entire length of the face 17. A part of the face 17 is covered by the connecting element 4 but the elongate slit 18 exposes a central region of the face 17 so that this region can serve as a stop surface for a bolt which here can abut directly on the bolt through the slit. In this way, high compressive forces can be transmitted via the piston rod 3 without the soft material of the connecting element 4 being loaded. Usually the bolts in hinges also consist of metal so that the forces can be transmitted directly via the metal piston rod 3 and the bolt. In view of the tensile loading on the connecting element 4, only small forces are acting on account of the configuration as a pressure damper so that an annular projection 16 on the connecting element 4 is sufficient for engaging on the groove 15.

In the exemplary embodiment shown, the connecting element 4 comprises a cylindrical seat 5 for a bolt. It is naturally also possible to make the shape of the seat 5 open, for example, two U-shaped legs can embrace a bolt so that it is possible for the bolt to engage since the high loads only occur during insertion of the piston rod 3 so that accessibility to the face of the bolt 3 is ensured through the slit 18 and the lower tensile loads during withdrawal of the piston rod 3 can also be absorbed by a U-shaped seat. In addition, the seat 5 can be configured differently from the cylinder shape, in particular the face 17 of the piston rod 3 can be completely accessible so that a corresponding component can be placed there for the transmission of compressive forces.

I claim:

1. A damper for furniture, the damper comprising a housing in which a piston connected to a piston rod is received displaceably with respect to the housing, where a fluid flows through a flow channel on or in the piston during a movement of the piston inside the housing, and a connecting element having a seat for coupling to a drive element that may be mounted in the seat is provided on the piston rod on the end section projecting from the housing, characterised in that the piston rod is formed from metal, the connecting element is made of plastic and is engaged on the piston rod, the seat has a cut-out section exposing a face of the piston rod mounted therein wherein the face of the piston rod is positioned to make direct mechanical contact with the drive element wherein there is a direct flow of force in the axial direction from the drive element-to the piston rod when pressure is applied thereto, and the piston rod comprises an annular groove, wherein the connecting element comprises an annular projection engaged with the annular groove.

2. The damper according to claim 1, characterised in that the cut-out section is slit-shaped and extends over the entire length of the face.

3. The damper according to claim 1, characterised in that the seat is configured as a substantially cylindrical eye.

4. The damper according to claim 1, characterised in that the connecting element is plugged onto the piston rod.

5. The damper according to claim 1, characterised in that the damper is configured as a pressure damper and during insertion of the piston rod into the housing higher damping forces are produced than during withdrawal.

6. The damper according to claim 1, characterised in that the piston is fixed on the piston rod by means of a metal slider.

7. A damper for furniture, the damper comprising a housing in which a piston connected to a piston rod is received displaceably with respect to the housing, where a fluid flows through a flow channel on or in the piston during a movement of the piston inside the housing, and a connecting element having a seat for coupling to a drive element that may be mounted in the seat is provided on the piston rod on the end section projecting from the housing, characterised in that the connecting element is made of plastic and is engaged on the piston rod, the seat has a cut-out section exposing a face of the piston rod mounted therein wherein the face of the piston rod is positioned to make direct mechanical contact with the drive element wherein there is a direct flow of force in the axial direction from the drive element-to the piston rod when pressure is applied thereto, and the piston rod comprises an annular groove, wherein the connecting element comprises an annular projection engaged with the annular groove.

8. The damper according to claim 7, characterised in that the cut-out section is slit-shaped and extends over the entire length of the face.

9. The damper according to claim 7, characterised in that the seat is configured as a substantially cylindrical eye.

10. The damper according to claim 7, characterised in that the connecting element is plugged onto the piston rod.

11. The damper according to claim 7, characterised in that the damper is configured as a pressure damper and during insertion of the piston rod into the housing higher damping forces are produced than during withdrawal.

12. The damper according to claim 7, characterised in that the piston is fixed on the piston rod by means of a metal slider.

* * * * *